US005688175A

United States Patent [19]

Matsuura et al.

[11] Patent Number: 5,688,175

[45] Date of Patent: Nov. 18, 1997

[54] GAME MACHINE

[75] Inventors: Kazuhito Matsuura, Komae; Yuichiro Sagawa, Yamato, both of Japan

[73] Assignee: Konami Co., Ltd., Hyogo-ken, Japan

[21] Appl. No.: 604,516

[22] Filed: Feb. 21, 1996

[30] Foreign Application Priority Data

Feb. 21, 1995 [JP] Japan ..... 7-055227

[51] Int. Cl.[6] ..... A63H 18/14

[52] U.S. Cl. ..... 463/61

[58] Field of Search ..... 463/61

[56] References Cited

U.S. PATENT DOCUMENTS 2,188,619 1/1940 Bernhardt ..... 463/61

FOREIGN PATENT DOCUMENTS 0516160 12/1992 European Pat. Off. .

3529097 2/1987 Germany .

*Primary Examiner*—William H. Grieb

*Attorney, Agent, or Firm*—Jordan and Hamburg

[57] ABSTRACT

A game machine includes: a running body which is movable on a support path; and a movable object which is movable as the running body moves and runs on a running path which is at least partly not parallel to the support path and located above the running body. The movable object and the running body are magnetically attracted. The magnetic attraction position can be changed.

32 Claims, 12 Drawing Sheets

GAME MACHINE

BACKGROUND OF THE INVENTION

This invention relates to a game machine in which a running body such as running model simulating, e.g., an automotive vehicle or a racing horse is caused to run along a running track by a movement of a movable object.

Game machines of this type are disclosed, for example, in Japanese Unexamined Patent Publication No. 1-94884. In the game machine disclosed in this publication, model horses simulating racing horses are moved by running bodies. The running bodies run on a support plate which also acts as a position detection plate, and the model horses are placed on a running plate simulating a horse race track. The running bodies and the model horses are provided with magnets, and the running plate is located between these magnets. Due to magnetic attraction between these magnets, the model horses run on running plate as the running bodies run.

However, in the above prior art game machine, the running plate on which the model horses run forms a single plane. Accordingly, the model horses can move only on the horizontal plane. For a horse race game, the movement only on the horizontal plane may make players feel as if they were really at a horse race track. However, a bicycle race and a car race are conducted on a sloped course. If an attempt is made to manufacture a game machine for simulating a race whose development is more or less influenced by the sloped course, a game exciting to the players cannot be realized if the race game is conducted on the running plate (and course) which defines only the single plane. Thus, interesting and exciting games cannot be realized.

SUMMARY OF THE INVENTION

It is an object of the present invention to provide a game machine which has overcome the problems residing in the prior art.

It is another object of the present invention to provide a game machine which can realize an exciting and thrilling game by moving movable objects upward and downward.

According to the present invention, a game machine comprises a running body for moving on a support path, and a movable object for moving as the running body moves and running on a running path which is parallel to the support path except for a specified portion.

In this game machine, the movable object moves on the running path as the running body moves. Since the running path is parallel to the support path except for a specified portion, the movable object moves on the running path while moving in the vertical direction with respect to the support path.

The running path is preferably located above the running body. Accordingly, the movable object moves on the running path located above the running body.

Preferably, at least one of the movable object and the running body carries a magnetic force generating member and the other carries a magnetic body. The running path may be so formed as to transmit a magnetic force from the magnetic force generating member. The magnetic force generating member and the magnetic body are preferably directed to each other with the running path therebetween.

With this arrangement, the magnetic force generating member and the magnetic body are attracted to each other due to a magnetic force from the magnetic force generating member. Accordingly, the movable object and the running body are magnetically attracted to and connected with each other by the magnetic force generating member and the magnetic body with the running path therebetween. Thus, as the running body runs on the support path, the movable object runs on the running path due to the magnetic attraction.

The running body may advantageously carries a position adjustment device for moving the magnetic force generating member or the magnetic body along the running path. Then, the magnetic force generating member or the magnetic body is constantly allowed to move along the running path by the position adjustment device, with the result that the magnetic attraction between the magnetic generating member and the magnetic body can be constantly maintained.

The position adjustment device may preferably be constructed by a vertical position adjustment mechanism for making the height of the magnetic force generating member or the magnetic body variable, and a posture adjustment mechanism for adjusting the posture of the magnetic force generating member or the magnetic body along a running direction of the movable object. With this arrangement, even if the height of the running path varies, the magnetic force generating member or the magnetic body can move along the running path by the vertical position adjustment mechanism and the posture adjustment mechanism.

The position adjustment device may further provided with a pivot adjustment mechanism for pivoting the magnetic force generating member or the magnetic body in a direction normal to a direction in which the posture adjustment mechanism adjusts the posture of the magnetic force generating member or the magnetic body. With this arrangement, even if the running path is inclined toward the direction normal to the running direction, the magnetic force generating member or the magnetic body can move along the running path by the pivot adjustment mechanism.

The vertical position adjustment mechanism preferably includes a pair of cylinder mechanisms each having a piston rod which is biased upward and movable in the vertical direction. The pivot adjustment mechanism preferably includes a connecting member which is pivotally connected with each of the pair of piston rods to connect the piston rods. The posture adjustment mechanism preferably includes a pivotal member pivotally connected with the connecting member. The magnetic force generating member or the magnetic body is preferably mounted on the pivotal member.

With this arrangement, the cylinder mechanisms movably support the connecting member of the pivot adjustment mechanism upward and downward: the connecting member pivotally supports the pivotal member of the posture adjustment mechanism; and the pivotal member pivotally supports the magnetic force generating member or the magnetic body.

The movable object may be advantageously provided with a drive portion which runs on the support path, and a driven portion which runs on an intermediate support path provided above and in parallel with the support path as the drive portion runs and carries the position adjustment device. Since the position adjustment device is provided in the driven portion, as the drive portion runs on the intermediate support path, the movable object runs on the running path due to the magnetic attraction between the magnetic force generating member and the magnetic body.

The intermediate support path may be provided with an electrode portion to which a supply voltage is applied, and the drive portion may includes a collecting electrode portion for coming into sliding contact with the electrode portion, and runs upon the supply voltage supplied via the collecting electrode portion. With this arrangement, the drive portion runs on the support path while receiving the supply voltage supplied from the collecting electrode portion which is in sliding contact with the electrode portion formed on the intermediate support path. Since the intermediate support path is in parallel with the support path, the contact state of the electrode portion and the collecting electrode portion can be constantly maintained at a fixed level.

The running path is preferably formed such that its upper surface is a continuously curved surface. This allows the movable object to smoothly run on the upper surface of the running path.

These and other objects, features and advantages of the present invention will become more apparent upon a reading of the following detailed description and accompanying drawings.

DETAILED DESCRIPTION OF THE PREFERRED EMBODIMENTS OF THE INVENTION

Hereafter, one embodiment of the invention is described in detail with reference to the accompanying drawings.

Figure 1:
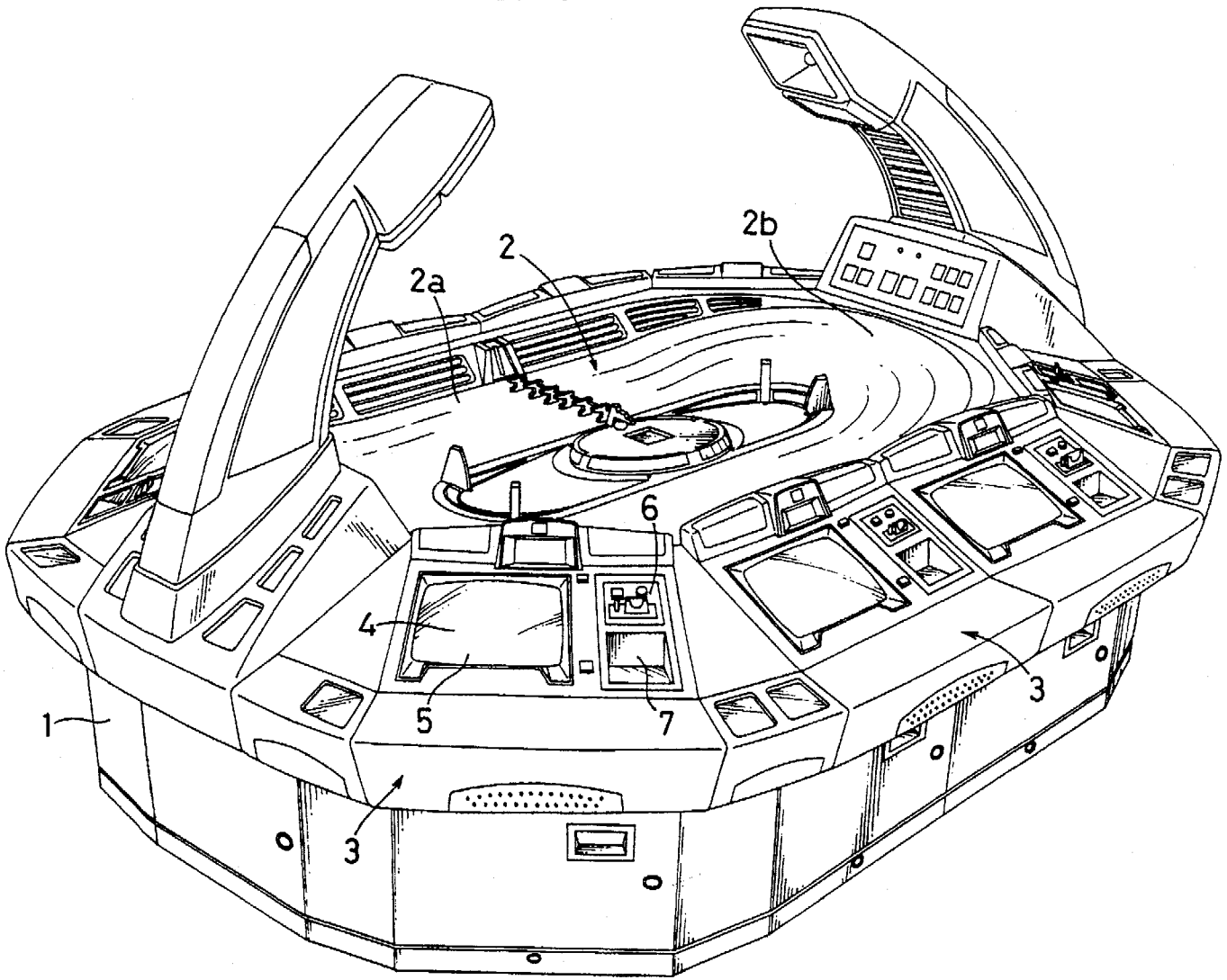
FIG. 1 is a perspective view showing an entire construction of a game machine as one embodiment of the invention.

FIG. 1 is a perspective view showing an entire construction of a game machine as one embodiment of the invention. In this embodiment, the invention is applied to a bicycle race game machine simulating a bicycle race (particularly, so-called "KEIRIN" race). In FIG. 1, indicated at 1 is a base, and by 2 a track formed on the base 1. The track 2 of this embodiment is of oval ring shape in which the opposite ends of two straight tracks 2*a* are connected by round tracks 2*b* of semicircular shape.

The round tracks 2*b* is formed to have a so-called bank shape which slops obliquely upward as it expands from the inner circumference toward the outer circumference. More specifically, the outer circumference of the center portion of the round track 2*b* (a portion farthest from the straight tracks 2*a*) is highest, and the inner circumference of the center portion is at the same height as the straight tracks 2*a*. Connection portion of the round track 2*b* and the straight track 2*a* is also formed such that the outer circumference portion is slightly higher than the inner circumference portion. Such connection portions permit the track 2 to have a continuously curved surface.

Operation units (or control panels) 3 are provided around the base 1. The operation unit 3 is adapted to show specified displays to a player of this game machine and to enable the player to input necessary information. The number of the operation units is equal to the number of players who can play the game at the same time in this machine (8 players in this embodiment).

Each operation unit 3 includes a monitor 4, an operation panel 5 formed of a transparent touch panel provided on the surface of the monitor 4, a coin insertion slot 6 and a coin pay slot 7. On the monitor 4 are displayed information necessary for the game, such as a start of the game, introduction of participating bicycle racers, odds, and prize. The player is allowed to input a variety of information by means of the operation panel 5. For example, the player makes a bet by means of the operation panel 5.

In this embodiment, six model bicycles 80 (not shown in FIG. 1) are placed on the track 2. The respective model bicycles are enabled to run on the track 2 by means of a drive mechanism to be described below.

Figure 2:
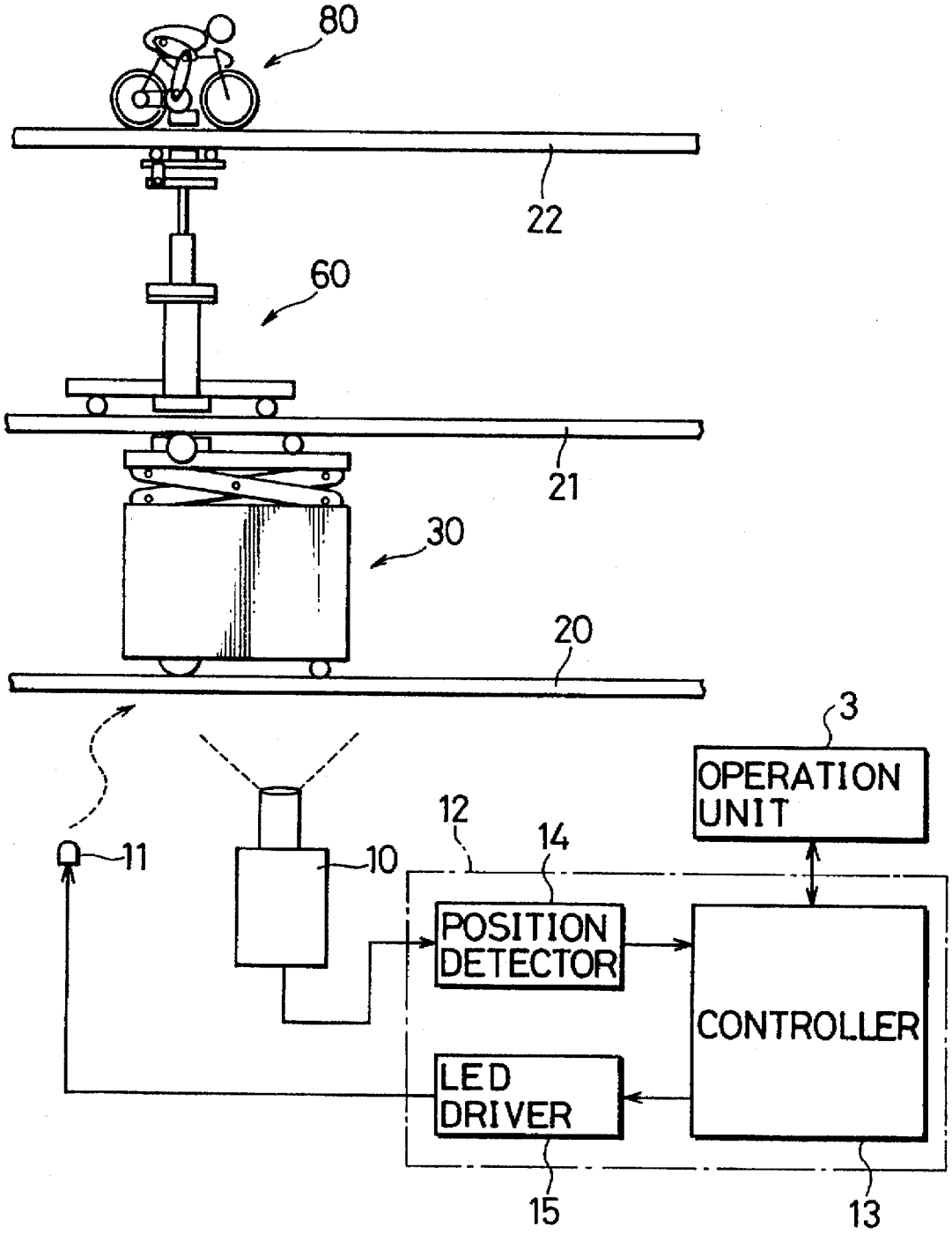
FIG. 2 is a diagram schematically showing a drive mechanism for driving a model bicycle used in this embodiment.

FIG. 2 is a diagram schematically showing the drive mechanism for driving the model bicycle. As shown in FIG. 2, the base 1 of the game machine includes a support plate 20 of glass or like material which permits a light beam to pass therethrough, an intermediate support plate 21 disposed in parallel with and above the support plate 20, and a running plate 22 having an upper surface which forms the track 2. Thus, the base 1 has a three-storied structure. Running bodies 30 and intermediate vehicles 60 are disposed between the support plate 20 and the intermediate support plate 21, and between the intermediate support plate 21 and the running plate 22, respectively. The numbers of the running bodies 30 and the intermediate vehicles 60 are each equal to the number of the model bicycles. The model bicycles 80 are disposed on the upper surface of the running plate 22 (i.e. on the upper surface of the track 2).

Figure 3:
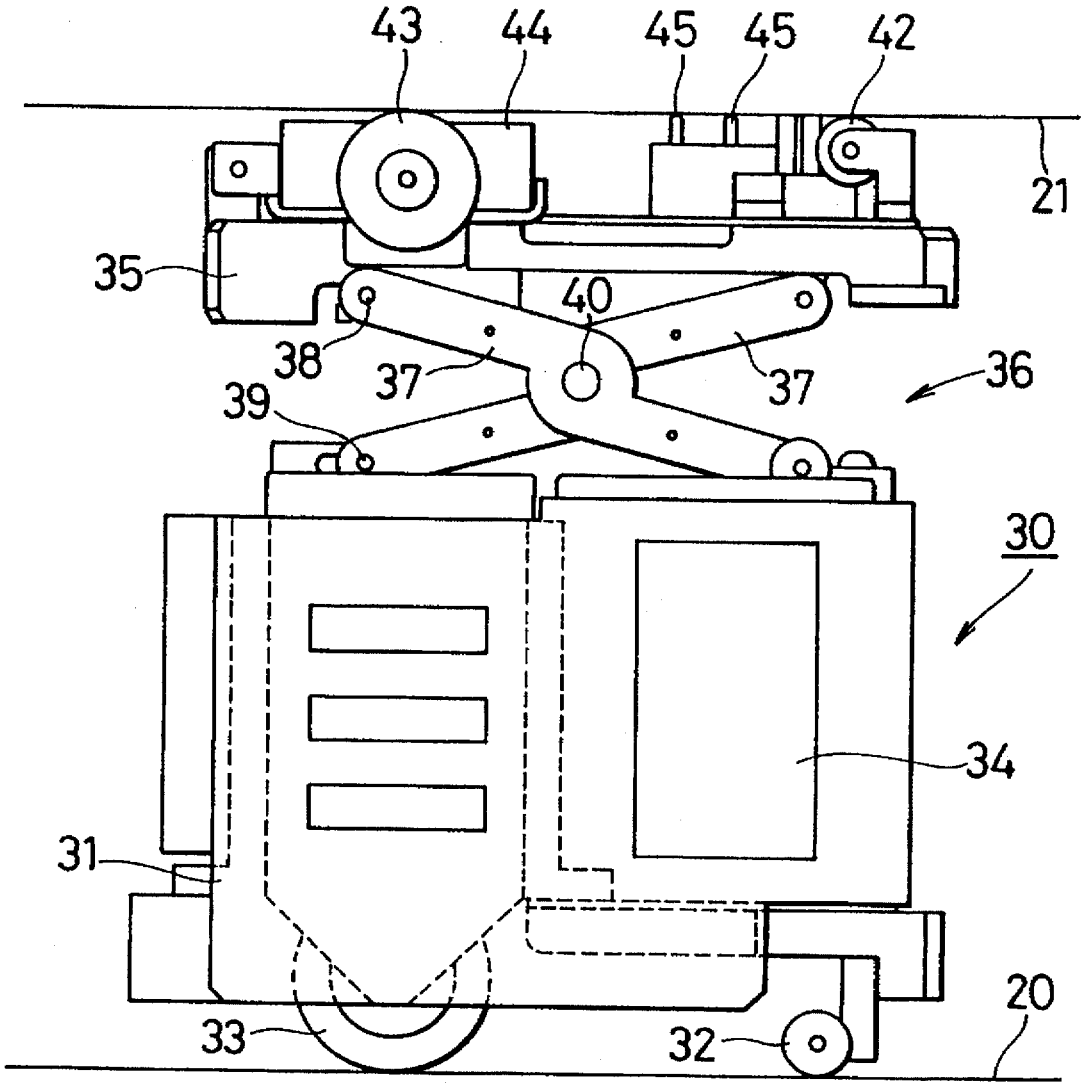
FIGS. 3 and 4 are front and right side views showing an external construction of a running body used in this embodiment, respectively.
Figure 4:
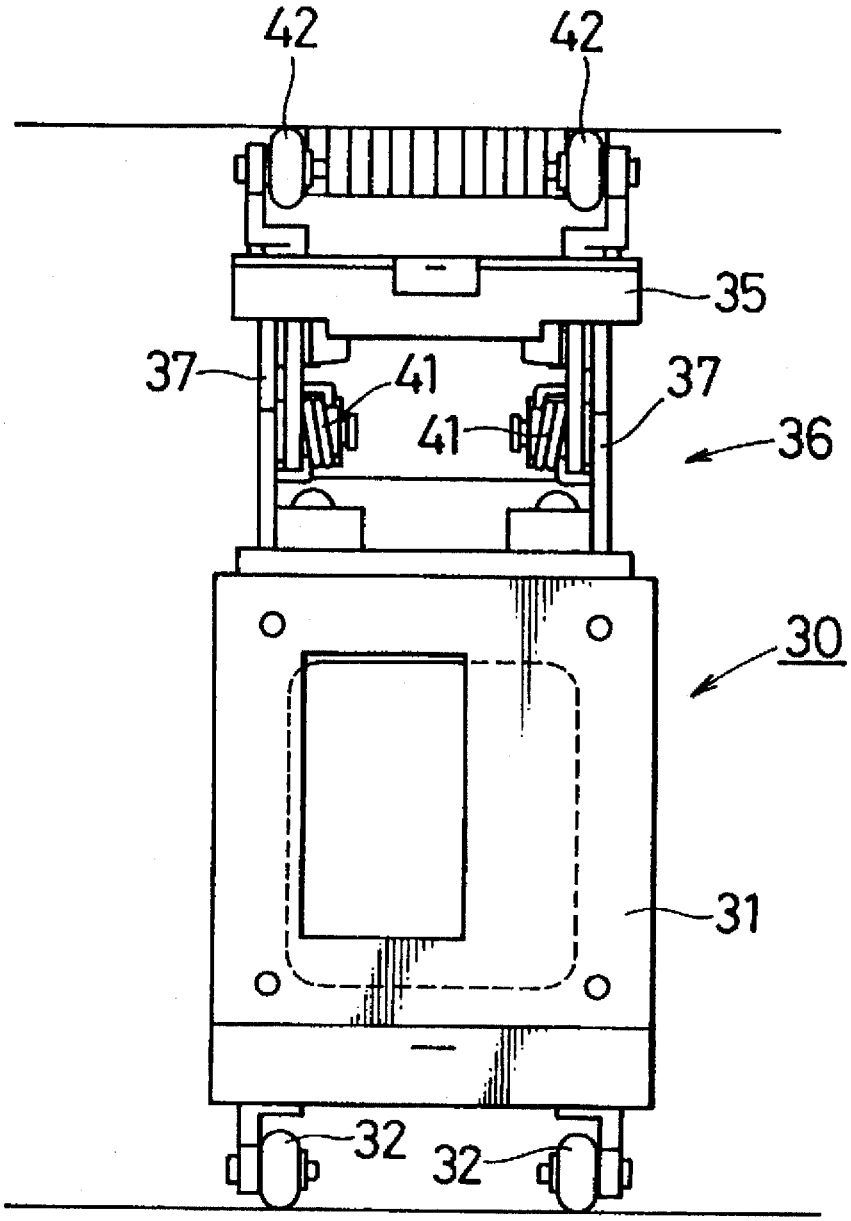

FIGS. 3 and 4 are front and right side views showing the external construction of the running body 30. In these FIGURES, indicated at 31 is a hollow rectangular casing of the running body 30. Casters 32 and drive wheels 33 are rotatably mounted at a front bottom portion of the casing 31 (right side in FIG. 3) and at a rear bottom portion of the casing 31 (left side in FIG. 3) with respect to a moving direction of the casing 31. An unillustrated drive shaft of the drive wheels 33 are coupled with a motor unillustrated in FIGS. 3 and 4, and the drive wheels 33 are driven by this motor. Indicated at 34 is a circuitry board housed in the casing 31. A variety of circuits such as a microcomputer to be described later are formed on the base plate 34.

Indicated at 35 is an upper base located above the casing 31. The casing 31 and the upper base 35 are connected via an extensible pantograph mechanism 36 such that they move with respect to each other in the vertical direction. The pantograph mechanism 36 includes two each of link members 37 provided at the upper left and right ends of the casing 31. The opposite ends of each link member 37 are connected with the upper part of the casing 31 and the lower part of the upper base 35 via pins 39 and 38, respectively. The two link members 37 at the left and right sides are connected in their center via a pin 40, and are biased by a spring 41 in such a direction that a distance between the casing 31 and the upper base 35 becomes larger.

A pair of casters 42 and a pair of rollers 43 are rotatably mounted at a front portion of the upper base 35 and at the left and right sides of the upper base 35 with respect to a moving direction of the upper base 35, respectively. The upper ends of the casters 42 and the rollers 43 are at the same height. As shown in FIG. 2, when the running body 30 is disposed between the support plate 20 and the intermediate support plate 21, the upper ends of the casters 42 and the rollers 43 come into contact with the bottom surface of the intermediate support plate 21 and accordingly rotate as the running body 30 runs. A permanent magnet 44 is disposed between the rollers 43. The upper end of the permanent magnet 44 is set slightly lower than that of the rollers 43. Thus, when the rollers 43 are in contact with the bottom surface of the intermediate support plate 21, the permanent magnet 44 is spaced apart from this bottom surface by a very small distance.

Indicated at 45 are a plurality of collecting electrodes disposed at the front portion of the upper base 35 with respect to its moving direction. The collecting electrodes 45 project from the upper base 35, and are spaced apart from one another at specified intervals. The collecting electrodes 45 are made projectable and retractable in the vertical direction by an unillustrated mechanism, and are biased upward by unillustrated springs. The collecting electrodes 45 are connected with the respective circuits on the base plate 34 via lead wires and a stabilized power source (both not shown in FIGS. 3 and 4). On the other hand, positive and negative electrodes (not shown) for supplying a power are provided on the bottom surface of the intermediate support plate 21. A supply voltage is supplied to the respective electrodes from an external power source.

Accordingly, the upper ends of the collecting electrodes 45 come into contact with the electrodes of the intermediate support plate 21 when the running body 30 is disposed between the support plate 20 and the intermediate support plate 21. Since the upper ends of the collecting electrodes 45 are constantly in sliding contact with the electrodes of the intermediate support plate 21 even if the running body 30 runs on the support plate 20, the supply voltage from the external power source is supplied to the running body 30 via the collecting electrodes 45.

More specifically, a pair of diodes in opposite conductive directions are connected with the respective collecting electrodes 45. Output lines of the positive direction diode are combined and connected with a positive terminal of the stabilized power source, whereas output lines of the negative direction diode are combined and connected with a negative terminal of the stabilized power source. Accordingly, if at least one collecting electrode 45 is in contact with the positive and negative electrodes of the intermediate support plate 21, the supply voltage from the external power source is supplied to the stabilized power source, and its polarity is constantly fixed. Thus, the positive and negative electrodes and the collecting electrodes are disposed such that at least one collecting electrode 45 is in contact with the positive and negative electrodes of the intermediate support plate 21 regardless of in which position on the support plate 20 the running body 30 is running.

Figure 5:
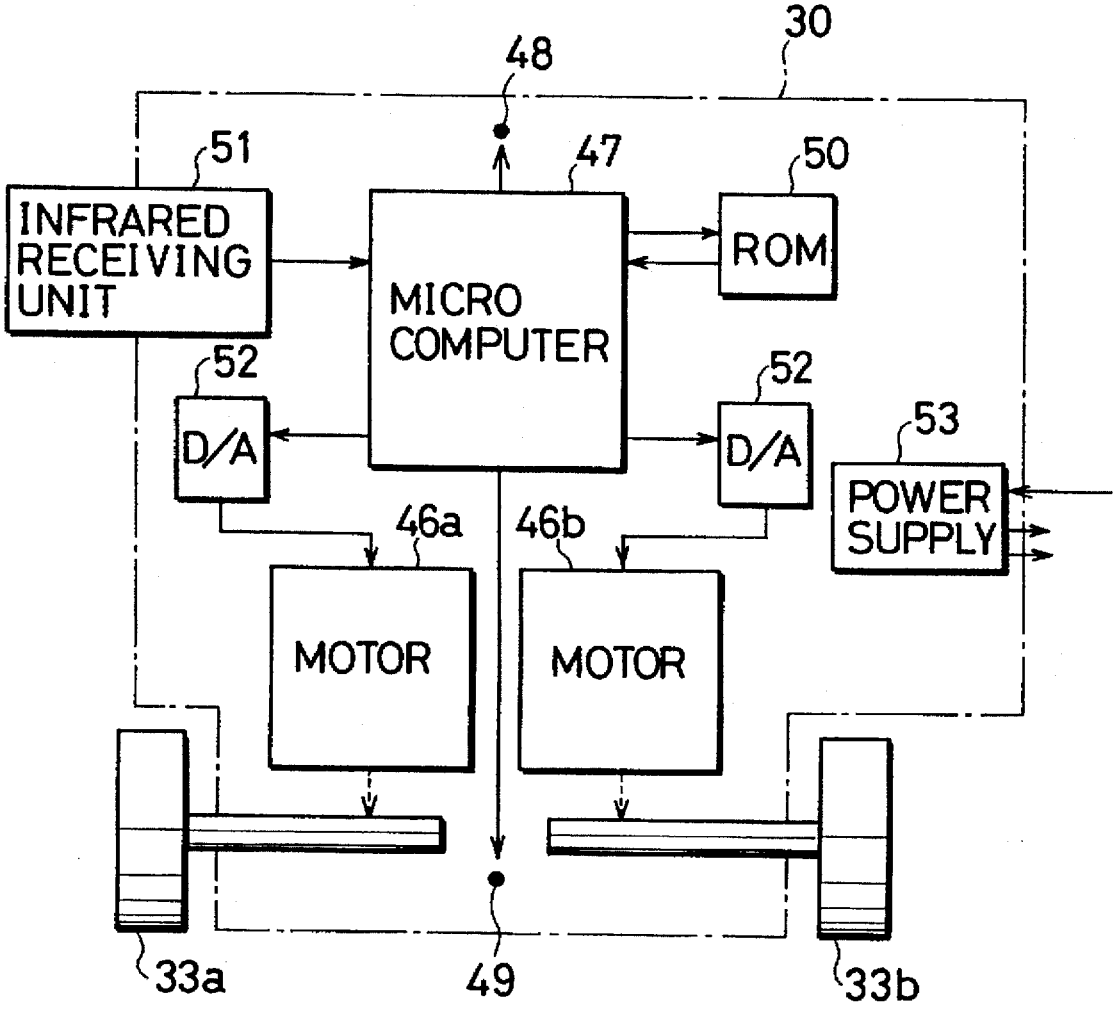
FIG. 5 is a block construction diagram of the running body when viewed from above.

FIG. 5 is a block construction diagram of the running body when viewed from above.

The running body 30 includes a pair of motors 46*a*, 46*b* for independently driving the pair of drive wheels 33*a*, 33*b* of resin or like material. In the description below, the drive wheels 33*a*, 33*b* and the motors 46*a*, 46*b* are indicated at 33, 46 respectively unless specified.

In this embodiment, DC motors are used as the motors 46 so that the speed of the running body 30 can be duty-controlled and the running body 30 can run backward (by inversion of polarity of a supply current) if necessary. Alternatively, pulse motors may be used so as to enable a speed control using a pulse frequency. Reduction gears are provided in a plurality of positions between a rotatable shaft of the motor 46 and that of the drive wheel 33 to ensure a specified speed range.

Indicated at 47 is a one-chip microcomputer as a controller of the running body 30. The microcomputer 47 analyzes a signal transmitted from a transmission LED 11 of a game machine main body 12 to generate a run control signal for the running body 30, and causes front and rear LEDs 48, 49 for emitting infrared rays. A ROM 50 is adapted to store an operation program of the microcomputer 47. Indicated at 52 is a digital-to-analog (D/A) converter for converting a digital signal used for a speed control which is output from the microcomputer 47 into an analog signal used to drive the motors 46.

The front and rear LEDs 48, 49 are disposed at a front center portion and at a rear center portion of the casing 31 (not shown in FIG. 5) of the running body 30 such that they are both directed right downward. A frequency band of the infrared rays emitted when the front and rear LEDs 48, 49 are turned on corresponds with a transmission frequency band of an infrared filter provided on the front surface of a CCD camera 10 to be described later. Only the infrared rays having a frequency within the transmission frequency band can pass through the infrared filter. The infrared rays passed through the infrared filter are sensed by the CCD camera 10 disposed below the support plate 20. The LEDs 48, 49 are fabricated such that the rays propagate over a wide angle. The rays can be sensed by the CCD camera 10 in any arbitrary position on the support plate 20.

Indicated at 51 is an infrared ray receiving unit which includes a photodiode or the like for receiving an optical pulse signal transmitted from the transmission LED 11. The unit 51 is so disposed as to face downward at the center bottom portion of the casing 31 of the running body 30. The unit 51 is, for example, exposed so as to receive the rays over a wide range. Indicated at 53 is a stabilized power supply circuit for generating voltages from the supply voltage supplied from the external power source such as a voltage of 5 V necessary to operate the microcomputer 47 and a voltage of 6 V necessary to operate the motor.

Figure 6:
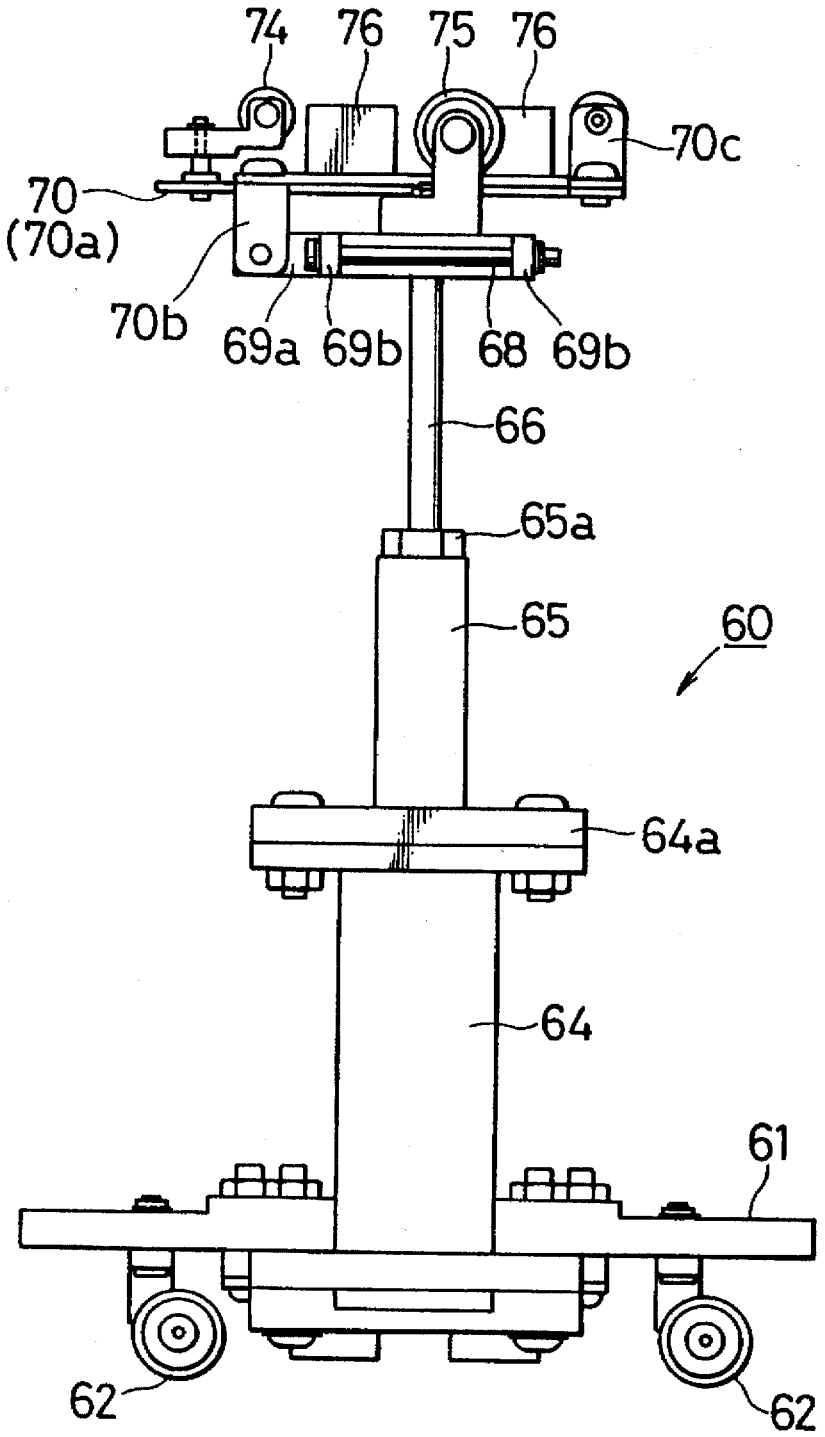
FIGS. 6, 7 and 8 are front, left side and plan views showing the external construction of an intermediate vehicle used in this embodiment, respectively.
Figure 7:
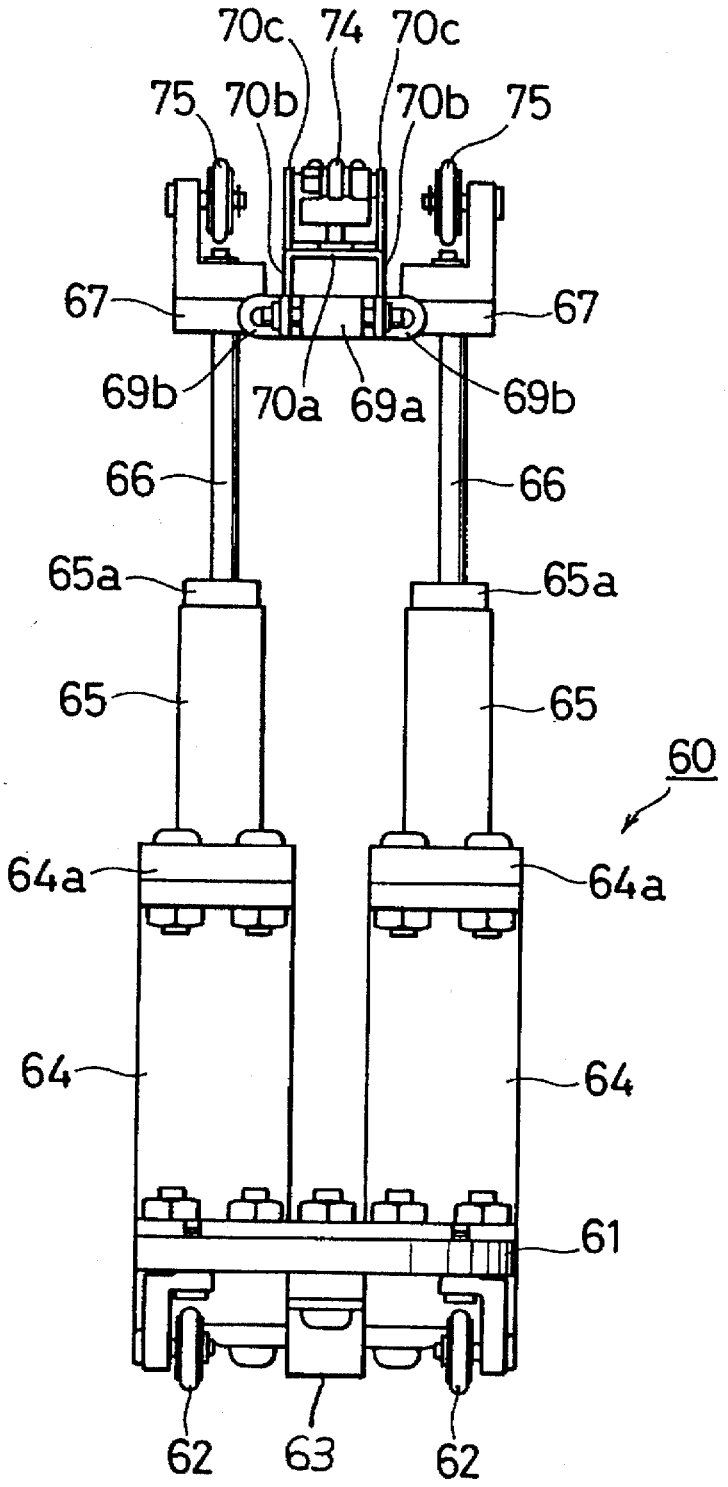
Figure 8:
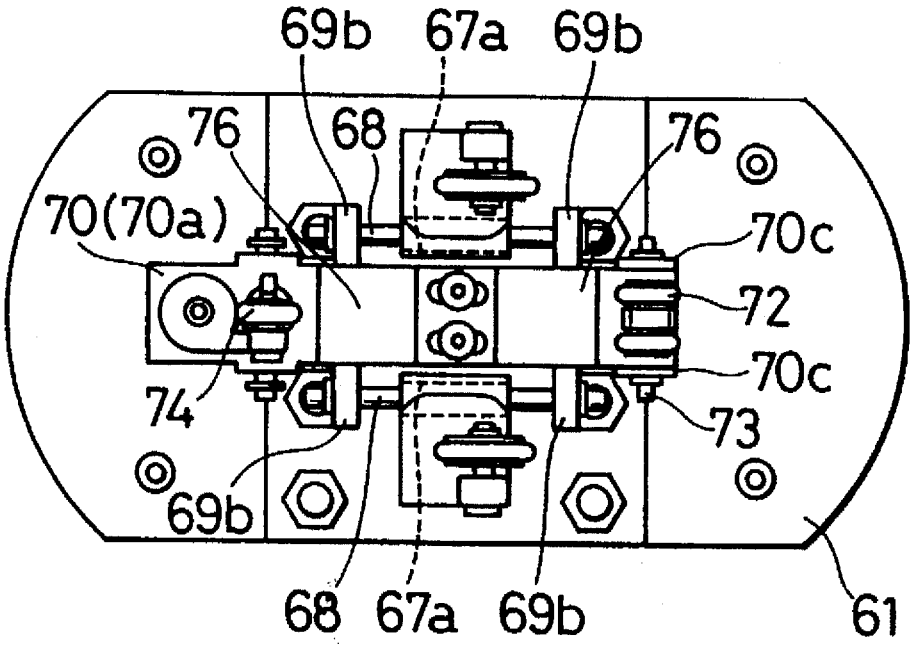

FIGS. 6, 7 and 8 are front, left side and plan views showing the external construction of an intermediate vehicle 60 used in this embodiment, respectively. In these FIGURES, indicated at 61 is a plate-like base. A pair of casters 62 are mounted at the opposite lateral ends of each of the front (right side in FIG. 6) and rear (left side in FIG. 6) portions of the base 61 with respect to a moving direction of the base 61. In other words, four casters 62 are mounted. Indicated at 63 is a permanent magnet mounted on the bottom surface of the base 61. The lower end of the permanent magnet 63 is set slightly higher than the lower ends of the casters 62. Accordingly, when the intermediate vehicle 60 is placed on the intermediate support plate 21, the permanent magnet 63 is located above and spaced apart from the upper surface of the intermediate support plate 21 by a very small distance.

Large cylinders 64 having an open upper end and a closed bottom stand upright at the opposite lateral ends of the base 61. A small cylinder 65 having a diameter smaller than that of the large diameter 64 is accommodated in each large cylinder 64. Similar to the large cylinders 64, the small cylinders 65 each have an open upper end and a closed bottom. An unillustrated spring is disposed between the bottom of the small cylinder 65 and that of the large cylinder 64. A piston rod 66 is accommodated in each small cylinder 65. An unillustrated spring is also disposed between the bottom of the piston rod 66 and that of the small cylinder 65.

Accordingly, the small cylinder 65 and the piston rod 66 are constantly biased upward. At the upper end of the large cylinder 64 is mounted a pressing member 64*a* for preventing the small cylinder 65 from coming out of the large cylinder 64, Further, at the upper end of the small cylinder 65 is mounted a nut 65*a* for preventing the piston rod 66 from coming out of the small cylinder 65.

A bracket 67 is secured on the upper end of each piston rod 66. In each bracket 67 is formed a through hole 67*a* which horizontally extends along a moving direction (lateral direction of FIG. 8) of the intermediate vehicle 60 as best shown in FIG. 8. The through holes 67*a* are formed on inner portions of the corresponding brackets 67. A rotatable rod 68 is inserted through each through hole 67*a*. The opposite ends of the rotatable rod 68 are rotatably connected with coupling plates 69. The coupling plate 69 includes a rectangular plate-like main body 69*a* and flanges 69*b* projecting in the lateral directions from the front and rear ends of the main body 69*a*. The flanges 69*b* are each formed with an unillustrated through hole through which the rotatable rods 68 are inserted.

A pivotal member 70 is pivotally mounted at the rear end (left end in FIG. 6) of the coupling plate 69. The pivotal member 70 includes a narrow plate-like base portion 70*a*, a pair of pivotal mount portions 70*b* extending downward from the opposite ends of the rear end (left end in FIG. 6) of the base portion 70*a*, and a pair of plate-like roller mount portions 70*a* extending upward from the opposite ends of the front end (right end in FIG. 6) of the base portion 70*a*.

An unillustrated through hole is formed to horizontally extend at the rear end of the coupling plate 69. A through hole is also formed in the pivotal mount portion 70*b* of the pivotal member 70. By inserting and fixing a pin 71 in the through holes of the coupling plate 69 and the pivotal mount portion 70*b*, the pivotal member 70 is pivotally mounted with respect to the coupling plate 69. An unillustrated spring is disposed between the coupling plate 69 and the pivotal member 70. This spring constantly biases the pivotal member 70 upward.

On the other hand, a through hole is formed in the roller mount portion 70*a* of the pivotal member 70. By inserting a rotatable shaft 73 of a roller 72 through this through hole, the roller 72 is rotatably mounted with respect to the pivotal member 70. Indicated at 74 is a caster mounted at the rear end of the base portion 70*a* of the pivotal member 70. Similarly, a caster 75 is mounted above the bracket 67. The rollers 72 and the casters 74, 75 are set such that their upper ends are at the same height in an extended state of the two smaller cylinders 65 and the two piston rods 66.

Indicated at 76 is a permanent magnet mounted on the upper surface of the base portion 70*a* of the pivotal member 70. The upper end of the permanent magnet 76 is set slightly lower than the upper ends of the rollers 72 and the casters 74, 75. Accordingly, when the intermediate vehicle 60 is disposed between the intermediate support plate 21 and the running plate 22, the permanent magnet 76 is located below and spaced apart from the lower surface of the running plate 22 by a very small distance.

In the above construction, even if the distance between the intermediate support plate 21 and the running plate 22 changes, the small cylinders 65 and the piston rods 66 suitably extend and contract, with the result that the roller 72 and the casters 74, 75 are constantly in contact with the lower surface of the running plate 22 and roll along the lower surface of the running plate 22 as the intermediate vehicle moves. In addition, even if the running plate 22 tilts along the moving direction (lateral direction in FIG. 6) of the intermediate vehicle 60, the pivotal plates 70 pivot with respect to the coupling plates 69 and thereby the rollers 72 and the casters 74 incline with respect to the moving direction. As a result, the rollers 72 and the casters 74 constantly remain in contact with the lower surface of the running plate 22.

Further, even if the running plate 22 tilts along a direction (lateral direction in FIG. 7) normal to the moving direction of the intermediate vehicle 60, the pairs of small cylinders 65 and piston rods 66 extend and contract independently of each other, with the result that the casters constantly remain in contact with the lower surface of the running plate 22. Thus, even if the running plate 22 has a three-dimensionally curved surface, the rollers 72 and the casters 74, 75 are constantly in contact with the bottom surface of the running plate 22 as long as the curved surface is continuous, i.e. can follow the height change of the curved surface.

The length and the extension/contraction stroke of the large cylinders 64, the small cylinders 65 and the piston rods 66 are so set as to sufficiently respond to a distance change between the intermediate support plate 21 and the running plate 22. In this embodiment, when the model bicycle 80 to be described later is located on the linear track 2*a* (i.e. when the distance between the intermediate support plate 21 and the running plate 22 are shortest), the small cylinders 65 and the piston rods 66 contract to their positions closer to their most contracted positions. On the other hand, when the model bicycle 80 is located at the outer circumference of the center portion of the round track 2*b* (i.e. when the distance between the intermediate support plate 21 and the running plate 22 is longest), the small cylinders 65 and the piston rods 66 extend to their positions closer to their most extended positions.

FIGS. 9, 10, 11 and 12 are front, left side, right side and plan views showing the external construction of the model bicycle, respectively. In these FIGURES, indicated at 81 is a main frame of the model bicycle 80, by 82 a front wheel, and by 83 a rear wheel. The wheels 82 and 83 are both rotatably mounted on the main frame 81. Indicated at 84 is a drive pulley which is so secured on a rotatable shaft of the rear wheel 83 as to rotate together with the rear wheel 83. Indicated at 85 is a crank pulley which is rotatably mounted on the main frame 81. A drive force of the drive pulley 84 is transmitted to the crank pulley 85 via a rubber belt 86, with the result that, as the rear wheel 83 rotates, the crank pulley 85 rotates in the same direction.

Figure 9:
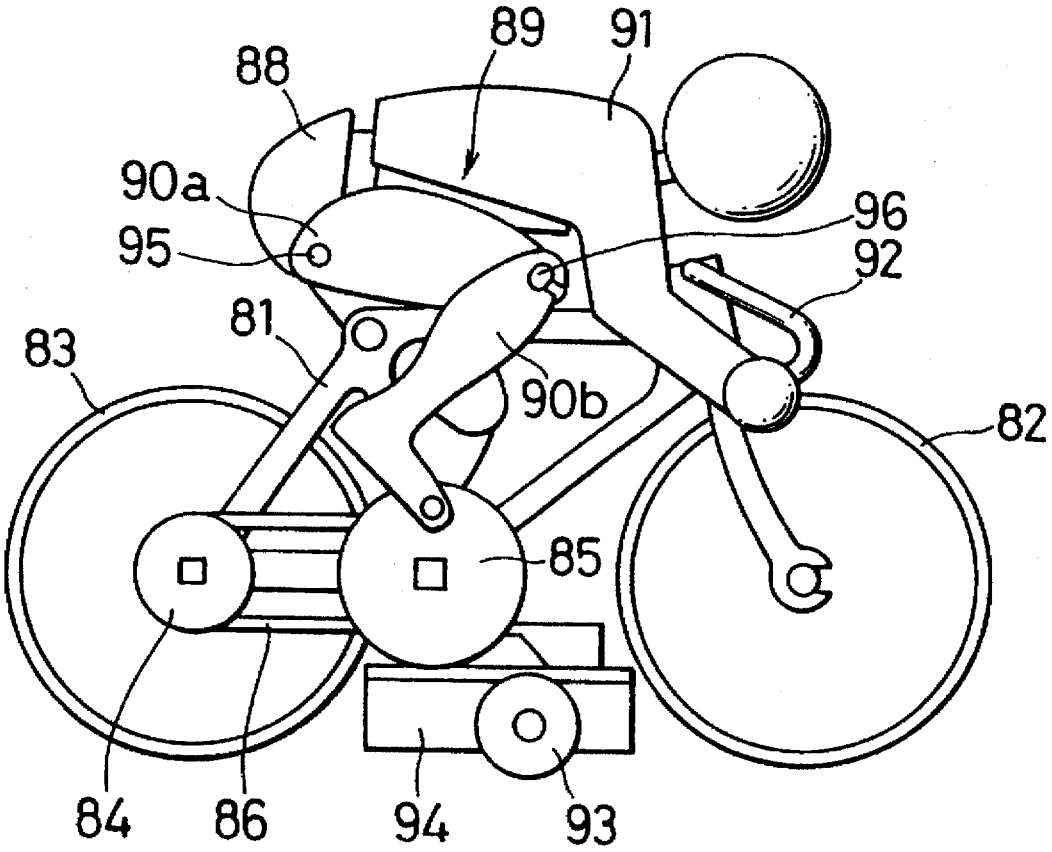
FIGS. 9, 10, 11 and 12 are front, left side, right side and plan views showing the external construction of the model bicycle, respectively.
Figure 10:
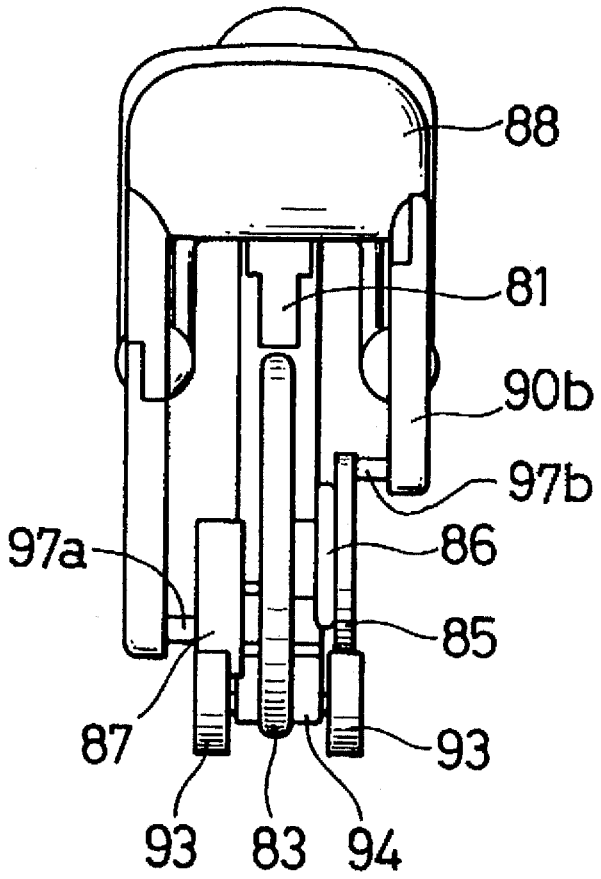
Figure 11:
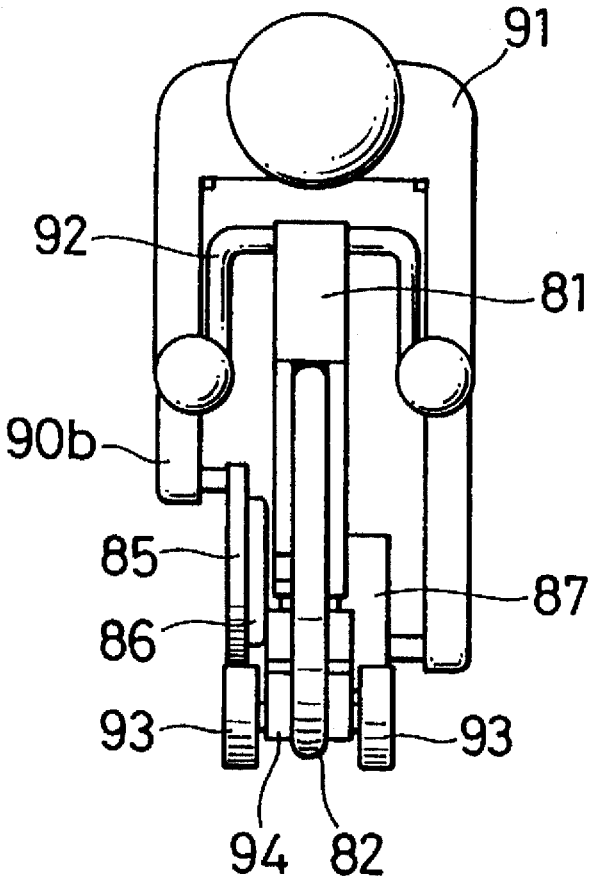
Figure 12:
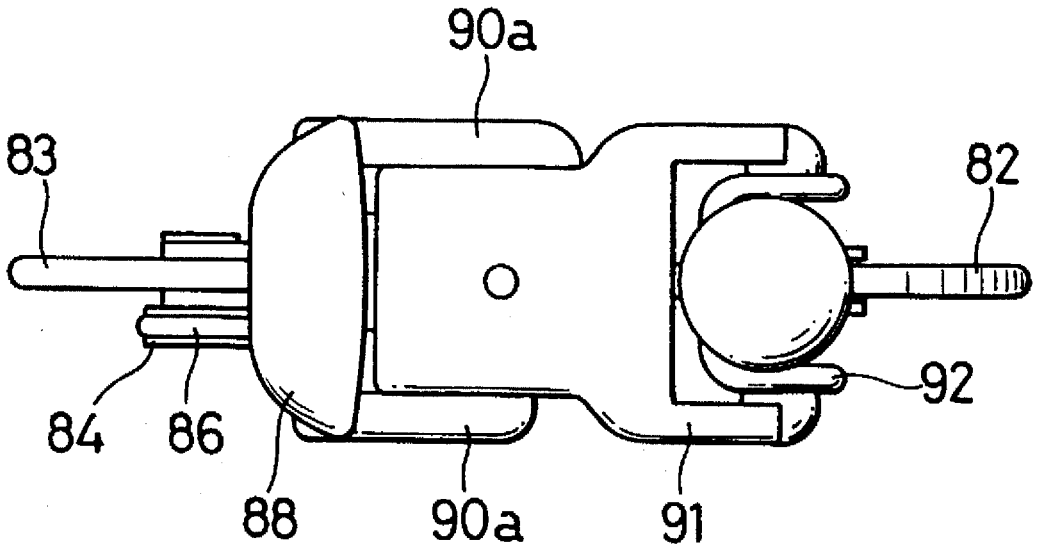

Though unillustrated in FIG. 9, a crank pedal 87 is rotatably mounted on the main frame 81 on the side opposite from the crank pulley 85. Being secured on a rotatable shaft of the crank pulley 85, the crank pedal 87 rotates together with the crank pulley 85.

Indicated at 88 is a model racer main body. Leg units 89 are provided at the left and right sides of the model racer main body 88. Each leg unit 89 includes two link members 90*a*, 90*b* which are connected with each other via a pin 96. The link members 90*a* are also connected with the model racer main body 88 by pins 95, the link members 90*b* are connected with the crank pulley 85 and the crank pedal 87 via pins 97*a* an 97*b*, respectively. Accordingly, the leg units 89 move as the crank pulley 85 rotates. In other words, the model racer moves as if a real bicycle racer were riding a bicycle.

Indicated at 91 is an upper body unit of the model racer. The front end (right end in FIG. 9) of the model racer is secured on a handle unit 92 provided at the front end of the main frame 81.

Indicated at 93 are a pair of support rollers rotatably mounted on the lower portion of the main frame 81. The lower ends of the support rollers 93 are set lower than a line connecting the lower ends of the front and rear wheels 82 and.83. Thus, when the model bicycle 80 is placed on the running plate 22, it is supported by the rear wheel 83 and the pair of support rollers 93, and the front wheel 82 is supported slightly above the running plate 22.

Indicated at 94 is a permanent magnet mounted on the lower portion of the main frame 81. The lower end of the permanent magnet 94 is set slightly higher than the lower ends of the rear wheel 83 and the support rollers 93. Accordingly, when the model bicycle 80 is placed on the upper surface of the running plate 22, the permanent magnet is located above and spaced apart from the upper surface of the running plate 22 by a very small distance.

The running body 30, intermediate vehicle 60 and model bicycle 80 described above are disposed such that the permanent magnets 44, 63 and the permanent magnets 76, 94 face each other with the intermediate support plate 21 and the running plate 22 therebetween, respectively. Accordingly, the running body 30, the intermediate vehicle 60 and model bicycle 80 are pulled toward each other by the attraction of the permanent magnets 44, 63, 76 and 94. Thus, as the running body 30 runs, the intermediate vehicle 60 runs on the intermediate support plate 21 and the model bicycle 80 runs on the running plate 22.

Referring back to FIG. 2, indicated at 10 is the CCD camera as an area sensor, by 11 the transmission LED as a transmission means, and by 12 the game machine main body. The main body 12 is provided with a controller 13, a position detector 14 disposed between the CCD camera 10 and the controller 13, and a LED driver 15 disposed between the controller 13 and the transmission LED 11.

The controller 13 centrally controls an entire operation of the game machine according to this embodiment. The controller 13 includes a built-in computer (microcomputer), a ROM in which a game program and other programs are stored in advance, and a RAM for temporarily storing a position detection data from the position detector 14 and data being processed and storing necessary parameters.

In the case that there is provided one CCD camera 10, it is disposed substantially in the middle of the base 1 and at a specified height below the support plate 20 such that its sensing surface faces upward and the substantially entire lower surface of the base 1 falls within its view frame. Accordingly, the support plate 20 is a plate member of glass or like transparent material. The running body 30 is sensed by the CCD camera 10 through the support plate 20. In consideration of the view frame of the CCD camera 10, the support plate 20 preferably has a square or circular shape. However, in this embodiment, the shape of the support plate 20 conforms to the shape of the track 2.

As already known, the CCD camera 10 is such that a plethora of photodetectors which are solid-state photoelectric conversion elements are arranged in a matrix. For example, if the scanning cycle of the CCD camera 10 is selectable between 1/60 sec. per field and 1/30 sec. per frame, an image is picked up using 1 field as a scanning cycle. The CCD camera 10 outputs an electrical (image) signal having a converted level corresponding to an amount of rays received by the respective photodetectors.

An infrared transmission filter is disposed on a light receiving surface of the CCD camera 10 adopted in this embodiment so that the CCD camera receives only the infrared rays within a specified frequency band. In this way, an erroneous operation caused by external light is prevented. In place of the single CCD camera 10, a plurality of CCD cameras may be used. In such a case, the lower surface of the support plate 20 is divided into a plurality of areas, and images of the respective areas are picked up by the respective CCD cameras. With this arrangement, an image resolving power, i.e. a position detection accuracy can be improved.

The position detector 14 includes a frame memory in which the image signal from the CCD camera 10 is written, and an image processor for reading the content of the frame memory, detecting the position of the running body 30, and outputting coordinates representative of the detected position in the form of a detection signal. In this embodiment, the detection is performed in real time, more accurately, repeatedly at intervals of a very short period. Accordingly, in order to perform the image signal writing operation and the image signal reading operation in a parallel manner, there are provided two frame memories each having a storage capacity of 1 frame. The write only frame memory and the read only frame memory are switched in accordance with a switch signal from the image processor.

A technique for detecting the position of the running body 30 which is adopted by the image processor may be suitably selected from known image processing techniques. Since two LEDs 48, 49 are loaded in the running body 30 in this embodiment, an exemplary technique may be such that a suitable threshold value is set for the signal level of the image signal to convert the image into a binary data, and the position of a luminescent spot in the image is detected by means of pattern matching, labeling or the like.

The transmission LED 11 is a light emitting element for emitting, e.g. infrared rays. Similar to the CCD camera 10, the transmission LED 11 is disposed at a specified height below the support plate 20 such that it emits light upward. An infrared signal from the transmission LED 11 is transmitted toward the running body 30 running on the support plate 20 over a specified angle. A single transmission LED may be disposed in the center portion but, in order to more securely transmit the signal, it is better to provide a plurality of transmission LEDs so as to cover the respective divided areas of the support plate 20.

The transmission LEDs 11 are connected with the LED driver 15 which controllably drives the transmission LEDs 11 in accordance with a turn-on command signal from the controller 13 so that the transmission LEDs 11 transmit specified infrared pulse signals. The turn-on command signal is used to turn on the respective transmission LEDs 11. In the game machine in which a plurality of transmission LEDs 11 are provided, the LED driver 15 controllably drives the transmission LEDs 11 such that the transmission LEDs 11 connected in parallel with one another transmit synchronized optical pulse signals. Thus, even if the areas covered by the transmission LEDs 11 partly overlap, no interference occurs, thereby preventing an erroneous operation.

Next, the operation of the bicycle race game machine according to this embodiment is described.

Upon application of power to the game machine, the entire system is first initialized to reset values of a variety of variables. Further, a communication port of the controller 13 is initialized.

Subsequently, the controller 13 performs a processing to start one race. Specifically, a game start screen and an odds display screen are displayed on the monitor 4 of each operation unit 3. At this stage, it is waited on stand-by until the respective players make bets by means of the operation units 5, and then the respective model bicycles 80 are moved to a start line drawn in a specified position of the track 2. Further, the position detection by the position detector 14 is started to detect initial positions of the model bicycles 80 located along the start line (precisely speaking, the initial positions of the running bodies 30).

A race start processing includes determination of a scenario of this race, i.e. at which speeds the respective model bicycles 80 run and in which order the respective model bicycles 80 finish the goal (hereafter, race development). If the race development is same for every race, then the players lose their interest in the bicycle game. Accordingly, a plurality of race developments are stored in the ROM of the controller 13, and any one of these developments is selected every time the race start processing is performed.

Particularly, in the game machine according to this embodiment, the running body 30 for driving the model bicycle 80 runs along any desired course on the support plate 20 in accordance with a run control signal from the controller 13. Accordingly, the race development data includes a course data concerning as to which course each running body 30 runs (i.e. which course on the track 2 each model bicycle 80 runs). If the respective model bicycles 80 runs the same nonoverlapping courses every time, the course data may be provided separately from the race development data. Alternatively, if there is no predetermined race development and a run control for each model bicycle 80 is executed at specified intervals based on the position of the model bicycle 80, an operation of determining the race development can be omitted.

Thereafter, based on the determined race development and the detected initial positions of the respective model bicycles 80, target positions of the respective model bicycles 80 immediately after the start of the race is determined by the controller 13. For example, the target position is a position each model bicycle 80 reaches 1 sec. after the start.

Upon determination of the target positions, differences between the initial positions of the respective model bicycles 80 and the target positions thereof are calculated, and command values are output to the respective running bodies 30 in accordance with the calculated differences. The command values are converted by the infrared LED driver 15 into signals used to drive the transmission LED 11. Thus, the infrared optical pulse signals corresponding to the command values are transmitted from the transmission LED 11 to the respective running bodies 30.

The speed and direction of each running body 30 are instructed in accordance with only a target speed data. More specifically, the speed instruction is given to the wheels on one specific side, e.g., to one of the motors 46*a*, 46*b* for driving the drive wheels 33*a*, 33*b*, and the direction instruction is given in the form of a rotating speed difference of one motor (on the specific side) with respect to the rotating speed of the other motor The direction of the running body 30 may be similarly controlled by independently instructing the rotating speed to the respective motors 46*a*, 46*b*.

When the infrared ray receiving unit 51 of the running body 30 receives the infrared optical pulse signal from the transmission LED 11, the microcomputer 47 analyzes this signal; calculates the command value; and sends a signal to the motors 46*a*, 46*b* so as to drive the motors 46*a*, 46*b* at specified rotating speeds corresponding to the command signal. The motors 46*a*, 46*b* rotate in accordance with the signal from the microcomputer 47, and thereby the drive wheels 33*a*, 33*b* rotates at specified rotating speeds. As a result, the running body 30 starts running in a specified direction at a specified speed corresponding to the command value.

As the running body 30 runs, the intermediate vehicle 60 and the model bicycle 80 start running in the same direction and at the same speed as the running body 30 due to the magnetic attraction of the permanent magnets 44, 63 and due to magnetic attraction of the permanent magnets 76, 94, respectively.

When the respective model bicycles 80 start running, thereby starting the race, the controller 50 receives data representative of current positions of the respective running bodies 30 which are detected by the position detector 14 at specified intervals (e.g. every several tens of msec.), and confirms the current positions of the running bodies 30. When the running bodies 30 reach the target positions, next target positions are calculated. A command value is calculated in accordance with the target position, and an infrared optical pulse signal is transmitted to the running bodies 30 via the infrared LED driver 15 and the transmission LED 11.

Upon receipt of the command value represented by the infrared pulse signal from the transmission LED 11, the microcomputer 47 of the running body 30 drives the motors 46*a*, 46*b* at the specified rotating speed in accordance with the command value as described above. As a result, the running body 30 (or the model bicycle 80) runs at the specified speed in the specified direction. The running of each running body 80 is controlled in accordance with the race development determined by repeating the above operation, and the race is performed.

During the race, the rollers 72 and the casters 74, 75 of the intermediate vehicle 60 constantly roll along the lower surface of the running plate 22 independently of the distance change between the intermediate support plate 21 and the running plate 22. Accordingly, the permanent magnet 76 provided in the upper portion of the intermediate vehicle 60 is also constantly spaced part from the lower surface of the running plate 22 by the very small distance. Thus, regardless of in which position of the track 2 the model bicycle 80 is, the model bicycle 80 is magnetically connected with the intermediate vehicle 60 due to the magnetic attraction, and runs as the intermediate vehicle 60 runs.

The game ends after all the model bicycles 80 run the track 2 around a predetermined number of times and finish the goal line drawn on the track 2. Upon completion of the game, the controller 13 stops sending the command values. Thereafter, the post-game processing is performed. Specifically, the running bodies which won the prizes are determined and displayed, and coins are paid to the player(s) who made a successful bet.

The race is performed as described above, In the game machine according to this embodiment, the intermediate vehicle 60 is disposed between the running body 30 and the model bicycle 80, and is provided with a function of responding to a change in the shape of the track 2 (running plate 22). Accordingly, even if the upper surface of the track 2 changes in a three-dimensional manner, the running of the model bicycle 80 can be controlled. Thus, the model bicycle 80 is enabled to run on the track 2 having the upper surface which changes in a three-dimensional manner, thereby realizing a thrilling and exciting game capable of making the players to feel as if they were really at the bicycle race course.

Particularly, in the game machine in which power to be applied to the running body 30 is supplied from the external power source, if the support plate 20 or the intermediate support plate 21 also acts as an electrode plate and the collecting electrodes 45 provided in the running body 30 are constantly brought into sliding contact with the electrode plate to collect the power, the contact state of the collecting electrodes 45 with the electrode plate changes if the shape of the electrode plate changes. As a result, the power may not be securely collected. Accordingly, as in this embodiment, it is preferable to form the support plate 20 on which the running bodies 30 run and the intermediate support plate 21 acting as an electrode plate flat and parallel to each other. With such an arrangement, it is impossible that the running body 30 have a function of responding to the change in the shape of the running plate 22.

In view of this, in this embodiment, the intermediate vehicle 60 is disposed between the running body 30 and the model bicycle 80 as described above, and is provided with a function of responding to the change in the shape of the running plate 22. With this arrangement, the running of the model bicycle 80 on the track 2 having the upper surface which changes in a three-dimensional manner can be controlled, using an advantage of power supply from the external power source which enables the running bodies 30 to be driven for a longer time in comparison with the construction in which a battery is mounted in the running body.

The detail of the game machine according to this embodiment is not limited to the foregoing embodiment, but may be modified in various manners. For example, although the height of the magnetic generating members or the magnetic bodies are made variable by extension and contraction of a cylinder mechanism in the foregoing embodiment, any known height adjustment mechanism may be adopted. Known height adjustment mechanisms include a pantograph mechanism, cantilever mechanism, and a direct support by, e.g. a spring, air spring or the like. Alternatively, if the variation of the height can be patterned, variation patterns may be stored and the height of the magnetic force generating members or magnetic bodies may be changed by a drive mechanism such as a motor. Further, a hydraulic pressure drive mechanism or air pressure drive mechanism may be used.

In the foregoing embodiment, the intermediate vehicle is disposed between the running body and the model bicycle because of power supply from the external power source. However, if a battery is mounted in the running body so that the running body runs without power supply from the external power source, the height adjustment mechanism may be mounted in the running body.

Further, although the running body is capable of running along any desired course on the support plate in the foregoing embodiment, the invention is applicable to a game machine in which predetermined paths are formed on the support plate and the running bodies run along these paths.

In addition, although the invention is applied to a bicycle race game machine in the foregoing embodiment, it may be applied to other race game machines such as car race game machines and horse race game machines. Further, although the invention is applied to the game machine of the type that all race developments are determined by the game machine and players predicts the determined race development in the foregoing embodiment, it may be applied to a game machine with which players themselves try to win the game by controlling the running of the model bicycles, etc.

As described above, according to the invention, the movable object runs on the running path which is at least partly not in parallel with the support path. Accordingly, the movable object is enabled to move in the vertical direction. Thus, by forming a track having a variable height, an exciting and thrilling game which makes players feel as if they were really at a race track can be realized, and a game machine which satisfies the players can be provided.

Since the movable object and the running body are magnetically connected due to the magnetic attraction between the magnetic force generating member and the magnetic body, the movable object is enabled to securely move as the running body moves in a simple construction.

Further, the magnetic force generating member or the magnetic body can be moved along the running path by the position adjustment device. Thus, the magnetic attraction between the magnetic force generating member and the magnetic body can be held at a fixed level independently of the height variation of the running path. As a result, the movable object can securely run as the running body runs.

Furthermore, the height variation of the running path can be coped with by the cooperation of the vertical position adjustment mechanism and the posture adjustment mechanism, the inclination of the running path toward the direction normal to the running direction of the movable object can be coped with by the inclination adjustment mechanism. Thus, the movable object is enabled to run while responding to a three-dimensional variation of the running path.

Further, since the support path and the intermediate support path are disposed in parallel with each other, the contact state of the collecting electrode portion and the electrode portion can be constantly maintained at a fixed level. Thus, power can be constantly stably supplied to the drive portion, and the movable object is enabled to move in the vertical direction while taking advantage of an external power supply method.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A game machine comprising:

a running body which is movable on a support path;

a movable object which is movable as the running body moves and which runs on a running path, the running path overlying the support path and overlying the running body;

one of the movable object and the running body carrying a magnetic force generating member and the other carrying magnetic body;

the running path being so formed as to transmit a magnetic force from the magnetic force generating member;

the magnetic force generating member and the magnetic body being directed to each other with the running path therebetween; and the running body carrying a position adjustment device which moves the magnetic force generating member of the magnetic body along the running path.

2. A game machine according to claim 1, wherein the position adjustment device includes:

a vertical position adjustment mechanism which makes the height of the magnetic force generating member or the magnetic body variable; and a posture adjustment mechanism for adjusting the posture of the magnetic force generating member or the magnetic body with respect to a running direction of the movable object.

3. A game machine according to claim 2, wherein the position adjustment device further includes a pivot adjustment mechanism for pivoting the magnetic force generating member or the magnetic body in a direction normal to a direction in which the posture adjustment mechanism adjusts the posture of the magnetic force generating member or the magnetic body.

4. A game machine according to claim 3, wherein:

the vertical position adjustment mechanism includes a pair of cylinder mechanisms each having a piston rod which is biased upward and movable in the vertical direction;

the pivot adjustment mechanism includes a connecting member which is pivotally connected with each of the pair of piston rods to connect the piston rods;

the posture adjustment mechanism includes a pivotal member pivotally connected with the connecting member; and the magnetic force generating member or the magnetic body is mounted on the pivotal member.

5. A game machine according to claim 1, wherein the running body further carries:

a drive portion which is runable on the support path; and a driven portion which runs on an intermediate support path provided above and in parallel with the support path as the drive portion runs, and carries the position adjustment device.

6. A game machine according to claim 5, wherein:

the intermediate support path includes an electrode portion to which a supply voltage is applied; and the drive portion includes a collecting electrode portion for coming into sliding contact with the electrode portion, and runs upon the supply voltage supplied via the collecting electrode portion.

7. A game machine according to claim 1, wherein the running path is formed such that its upper surface is a continuously curved surface.

8. A game machine comprising:

a support path;

a running body moveable on said support path;

a running path overlying said support path and having at least one sloping portion; and a movable object which is movable on said running path including said at least one sloping portion, said movement of said running body on said support path effecting said movement of said movable object on said running path.

9. A game machine according to claim 8 wherein said running path is an endless path having an inner circumferential section and an outer circumferential section, the outer circumferential section of said at least one sloping portion being at a higher elevation than the inner circumferential section of said at least one sloping portion.

10. A game machine according to claim 9 wherein said at least one sloping portion progressively slopes upwardly from said inner circumferential section to said outer circumferential section.

11. A game machine according to claim 8 wherein said endless running path includes two generally straight sections and two generally curved sections connecting the straight sections, said at least one sloping portion being located at said curved sections.

12. A game machine according to claim 8 wherein said support path is a generally horizontal path, said running path having said at least one sloping portion and also having a non-sloping portion, said non-sloping portion being generally parallel to said support path, said at least one sloping portion being disposed at an acute angle relative to said support path.

13. A game machine according to claim 8 wherein said support path is a generally horizontal support path, said running path having a non-sloping portion parallel to said support path, said running body including adjustment means in rollable contact with said running path, said adjustment means being vertically extendable and extractable to provide continuous rolling contact between said adjustment means and said running path as said running body moves between said horizontal support path and said running path with its non-sloping portion and its at least one sloping portion.

14. A game machine according to claim 8 wherein said support path is a generally horizontal support path, said running path having a non-sloping portion parallel to said support path, said running body including adjustment means in rollable contact with said running path, said adjustment means being pivotable about a generally horizontal axis to thereby provide continuous rolling contact between said adjustment means and said running path as said running body moves between said horizontal support path and said running path with its non-sloping portion and its at least one sloping portion.

15. A game machine according to claim 8 further comprising an intermediate path between said support path and said running path, said support path being parallel to said intermediate path, said running body having an upper part disposed between said running path and said intermediate path and a lower part disposed between said support path and said intermediate path, supply electrode means on said intermediate path, collecting means on said lower part of said running body providing sliding contact with said supply electrodes, and electric motor means on said lower part of said running body, said collecting means being connected to said motor means, said motor means driving said lower part of said running body on said support path.

16. A game machine according to claim 15 wherein said upper part of said running body has extendable and retractable means which are in constant contact with said running path including said at least one sloping portion of said running path.

17. A game machine according to claim 15 further comprising permanent magnet means on said first and second parts of said running body providing a constant magnetic attraction force between said first and second parts of said running body, whereby movement of said lower part of said running body on said support path effects like movement of said upper part of said running body on said intermediate path due to said constant magnetic attraction force.

18. A game machine according to claim 8 wherein said movable object overlies said running path and said running body underlies said running path, and permanent magnet means on said movable object and on said running body providing a substantially constant magnet attraction force between said moveable object and said running body, whereby movement of said running body effects movement of said moveable object due to said constant magnetic attraction force.

19. A game machine comprising:

a running body movable on a support path;

a movable object which is a movable as the running body moves and which runs on a running path, the running path overlying the running body and also overlying the support path;

permanent magnet means having a first part on said running body and a second part on said moveable object;

said first and second parts of said permanent magnet means being disposed on opposite sides of the running path in superimposed relationship such that the running body and the movable object move together on opposite sides of the running path due to the magnetic attraction between the first and second parts of the permanent magnet means.

20. A game machine according to claim 19 wherein the force of the magnetic attraction between the first and second parts of the permanent magnet means remains substantially constant.

21. A game machine according to claim 19 wherein said movable object and said running body each have rotatable members rotatably engaging said running path, said permanent magnet means being spaced from said running path.

22. A game machine according to claim 19 wherein said running body includes a drive portion which runs on said support path and a driven portion which runs on an intermediate support path disposed above and parallel to said support path, said intermediate support path underlying said running path;

supply voltage electrodes on said intermediate support path;

motor driven means on said driven portion of said running body for moving said running body on said support plate; and collecting electrode means on said driven portion of said running body providing sliding contact with said supply electrodes to thereby provide a voltage supply to said motor driven means.

23. A game machine according to claim 22 further comprising permanent magnet means on said drive portion and said driven portion, said drive portion driving said driven portion via said permanent magnet means.

24. A game machine according to claim 22 wherein said drive portion and said driven portion each include rotatable members which rollably engage said intermediate path, said permanent magnet means being spaced from said intermediate path.

25. A game machine according to claim 19 wherein said support path comprises a transparent material, said running body including an optical receiving unit, and control means underlying said support plate for transmitting an optical signal which passes through said transparent material of said support plate and which is received by said optical receiving unit.

26. A game machine according to claim 25 wherein said control means is operable to control the speed of movement of said running body.

27. A game machine comprising a transparent support plate, running means moveable on said support plate, said running means including a support structure having wheels and drive motors for driving said wheels, said running means further comprising speed control means for controlling the speed of said drive motors, and a main controller operable to transmit control signals through said transparent support plate to said speed control means on said running means such that said main controller is thereby operable to control the speed of movement of said drive motors.

28. A game machine according to claim 27 wherein said main controller includes transmission means underlying said transparent support plate for transmitting an optical signal, said speed control means on said running means having a receiver for receiving said transmitted optical signal.

29. A game machine according to claim 27 wherein said main controller includes position detecting means for detecting the position of said running means.

30. A game machine according to claim 29 wherein said position detecting means comprises a camera means disposed at an elevation lower than said transparent support plate.

31. A game machine according to claim 27 wherein said main controller includes a controller unit and a position detector for detecting the position of said running means, said controller unit calculating the difference between the detected position of the running means and a targeted position, said main controller having transmission means for transmitting a command signal corresponding to said difference to said speed control means on said running means.

32. A game machine according to claim 27 wherein said running means includes at least two of said wheels and a drive motor for each of said wheels, said speed control means being operable to independently drive each of said drive motors at different speeds to thereby change the direction of movement of the running means.

* * * * *